US006514681B2

(12) United States Patent
Jagannathan et al.

(10) Patent No.: US 6,514,681 B2
(45) Date of Patent: Feb. 4, 2003

(54) HIGH BROMIDE TABULAR GRAIN EMULSIONS PRECIPITATED IN A NOVEL DISPERSING MEDIUM

(75) Inventors: Seshadri Jagannathan, Pittsford, NY (US); Julia S. Tan, Rochester, NY (US); Roger L. Klaus, Rochester, NY (US); Philip J. Zola, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/864,546

(22) Filed: May 24, 2001

(65) Prior Publication Data

US 2002/0197572 A1 Dec. 26, 2002

(51) Int. Cl.[7] ..... G03C 1/005; G03C 1/494

(52) U.S. Cl. ..... 430/567; 430/569; 430/539; 430/642; 430/449

(58) Field of Search ..... 430/567, 569, 430/539, 642, 449

(56) References Cited

U.S. PATENT DOCUMENTS

| | | | | |
|---|---|---|---|---|
| 4,238,480 A | | 12/1980 | Sawyer | |
| 4,572,837 A | | 2/1986 | Poole et al. | |
| 5,147,659 A | | 9/1992 | Watanabe et al. | |
| 5,147,771 A | | 9/1992 | Tsaur et al. | |
| 5,147,772 A | | 9/1992 | Tsaur et al. | |
| 5,147,773 A | | 9/1992 | Tsaur et al. | |
| 5,210,013 A | | 5/1993 | Tsaur et al. | |
| 5,219,992 A | | 6/1993 | Specht et al. | |
| 5,252,453 A | | 10/1993 | Tsaur et al. | |
| 5,272,048 A | | 12/1993 | Kim et al. | |
| 5,391,477 A | | 2/1995 | Weatherill | |
| 5,411,849 A | * | 5/1995 | Hasegawa | 430/567 |
| 5,439,791 A | | 8/1995 | Kok et al. | |
| 5,474,885 A | | 12/1995 | Michiels et al. | |
| 5,476,760 A | | 12/1995 | Fenton et al. | |
| 5,503,971 A | * | 4/1996 | Daubendiek et al. | 430/567 |
| 5,536,817 A | | 7/1996 | Michiels et al. | |
| 5,726,008 A | * | 3/1998 | Maskasky | 430/569 |
| 5,763,151 A | | 6/1998 | Brust et al. | |
| 6,040,128 A | | 3/2000 | Boettcher et al. | |

FOREIGN PATENT DOCUMENTS

| | | |
|---|---|---|
| EP | 697 618 | 2/1996 |

* cited by examiner

*Primary Examiner*—Geraldine Letscher
(74) *Attorney, Agent, or Firm*—Andrew J. Anderson

(57) ABSTRACT

A radiation-sensitive emulsion comprised of an aqueous dispersing medium and a coprecipitated grain population including tabular grains containing greater than 50 mole percent bromide, based on silver, having {111} major faces, and accounting for greater than 90 percent of total grain projected area, wherein said dispersing medium is comprised of (a) a gelatin which has been modified to convert at least one carboxylic acid group thereof to a group that does not exhibit pH-dependent ionization within the pH range from 4.0 to 7.0, and (b) a polyalkylene oxide block copolymer surfactant.

20 Claims, No Drawings

HIGH BROMIDE TABULAR GRAIN EMULSIONS PRECIPITATED IN A NOVEL DISPERSING MEDIUM

FIELD OF THE INVENTION

The invention relates to photographic silver halide emulsions. More specifically, the invention relates high bromide, low grain size dispersity tabular grain emulsions precipitated in the presence of a modified gelatin.

DEFINITION OF TERMS

In referring to grains and emulsions containing two or more halides, the halides are named in order of ascending concentrations.

The term "high bromide" in referring to grains and emulsions indicates that bromide is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The term "coefficient of variation" or "COV" is defined as 100 times the standard deviation of grain ECD divided by average grain ECD.

The term "monodisperse" in referring to the grain population of a silver halide tabular grain emulsion indicates a COV of less than 25 percent.

The term "semi-monodisperse" in referring to the grain population of a silver halide tabular grain emulsion indicates a COV of less than 40 percent.

The term "pH" is the negative logarithm of the hydrogen ion concentration of a solution.

The term "pKa" is the negative logarithm of the thermodynamic acid dissociation constant (Ka) of an acid in solution.

The term "Ka" is defined by the relationship:

$$Ka=[[H^+][A^-]\div[HA]$$

where HA represents undissociated acid and $H^+$ and $A^-$ represent dissociated hydrogen ion and anionic moieties, respectively, that together constitute the acid HA.

The term "robust" is employed to indicate emulsions that show reduced disparity in grain and performance characteristics from one preparation to the next attributable to inadvertent variances in preparation conditions.

*Research Disclosure* is published by Kenneth Mason Publications, Ltd., Dudley House, 12 North St., Emsworth, Hampshire P010 7DQ, England.

BACKGROUND OF THE INVENTION

Photographic emulsions contain a dispersing medium and radiation-sensitive grains, which are typically silver halide microcrystals. Although markedly inferior in performance, other silver salts, such as silver thiocyanate, silver phosphate, silver cyanide, silver citrate and silver carbonate, can be precipitated in grain formation, as illustrated by Berriman U.S. Pat. No. 3,367,778, Maskasky U.S. Pat. Nos. 4,435,501, 4,463,087, 4,471,050 and 5,061,617 and *Research Disclosure*, Vol. 181, May 1979, Item 18153; Ikeda et al U.S. Pat. No. 4,921,784 and Brust et al U.S. Pat. No. 5,395,746.

The radiation-sensitive grains of photographic emulsions are usually formed by reacting a soluble silver salt, such as silver nitrate, with a soluble salt of the halide (or other anion), such as alkali, alkaline earth or ammonium halide. Grain nucleation and growth typically occurs in a dispersing medium comprised of water, dissolved salts and a hydrophilic colloid peptizer such as gelatin and gelatin derivatives. Precipitation can be undertaken under either acid or basic conditions. Under alkaline conditions the ammonium cation can act as a powerful ripening agent, usually resulting in large, highly ripened (sometimes described as spherical) grains. To minimize fog it is usually preferred to maintain a pH either near or on the acid side of neutrality during precipitation. Customarily strong mineral acids, such as nitric, sulfuric or hydrochloric acid are employed; however, other acids have been suggested from time to time for specific applications.

In the early 1980's it was recognized that a wide-ranging variety of performance advantages can be realized in high bromide silver halide emulsions when at least 50 percent of total grain projected area is accounted for by tabular grains. When interest initially focused on obtaining photographic performance advantages attributable to the tabular grains, the tabular grain emulsions contained a high proportion of nontabular grains, and the emulsions exhibited a high degree of grain size dispersity, attributable to the mixture of grain shapes as well as differences in the sizes of the tabular grains.

About a decade after the initial recognition of wide-ranging performance advantages for high bromide tabular grain emulsions, it was discovered that the presence of polyalkylene oxide block copolymer surfactants present during the formation of grain nuclei consisting essentially of silver bromide can significantly increase the proportion of the total grain population accounted for by tabular grains (e.g., where tabular grains account for greater than 90 percent of total grain projected area) and produce relatively monodisperse emulsions. These modified precipitation techniques allowed COV's of less than 40 percent, based on the total grain population, to be realized consistently. In fact, monodisperse emulsions with COV's of less than 25 percent based on total grains, and even extraordinary levels of monodispersity with COV's based on total grains ranging below 10 percent, were realized. Further, in these emulsion precipitations, tabular grains usually account for "substantially all" (defined as >97%) of total grain projected area. Preparations of relatively monodisperse high bromide tabular grain emulsions employing polyalkylene oxide block copolymer surfactants are illustrated by the following: Tsaur et al U.S. Pat. No. 5,147,771; Tsaur et al U.S. Pat. No. 5,147,772; Tsaur et al U.S. Pat. No. 5,147,773; Tsaur et al U.S. Pat. No. 5,171,659; Tsaur et al U.S. Pat. No. 5,210,013; Tsaur et al U.S. Pat. No. 5,252,453; Kim et al U.S. Pat. No. 5,272,048; and Fenton et al U.S. Pat. No. 5,476,760.

Although polyalkylene oxide block copolymer surfactants consistently increase the percentage of projected are accounted for by tabular grains and reduce the grain dispersity of high bromide tabular grain emulsions, Brust et al. U.S. Pat. No. 5,763,151 discloses that these surfactants are susceptible to allowing batch to batch variations in tabular grain mean thicknesses and ECD's when emulsion precipitation conditions are inadvertently varied during emulsion manufacture. In other words, the preparation processes have shown themselves to lack the degree of robustness desired using customary manufacturing control practices. Brust et al. discloses a method for improving the robustness of such preparation processes wherein the silver halide grain nuclei are grown at a pH in the range of from 3.0 to 8.0 and in the presence of at least a 0.01 M concentration of a partially dissociated acid having a pKa that is within 2.5 units of the growth pH and that forms a silver salt more soluble than the silver halide incorporated in the grains.

It would be desirable to provide alternative methods for further improving the robustness of high bromide silver halide tabular grain emulsions grown in the presence of polyalkylene oxide block copolymer surfactants.

SUMMARY OF THE INVENTION

In one aspect this invention is directed to a radiation-sensitive emulsion comprised of an aqueous dispersing medium and a coprecipitated grain population including tabular grains containing greater than 50 mole percent bromide, based on silver, having {111} major faces, and accounting for greater than 90 percent of total grain projected area, wherein said dispersing medium is comprised of (a) a gelatin which has been modified to convert at least one carboxylic acid group thereof to a group that does not exhibit pH-dependent ionization within the pH range from 4.0 to 7.0, and (b) a polyalkylene oxide block copolymer surfactant.

In a further aspect this invention is directed to a process of preparing a photographic emulsion having silver halide grains including tabular grains containing greater than 50 mole percent bromide, based on silver, having {111} major faces, and accounting for greater than 90 percent of total grain projected area, said process comprising: forming in the presence of a dispersing medium containing gelatin and a polyalkylene oxide block copolymer surfactant a population of silver halide grain nuclei containing twin planes, and growing the silver halide grain nuclei containing twin planes in the dispersing medium to form tabular silver halide grains, wherein (a) gelatin in the dispersing medium comprises a modified gelatin of the formula Gel-C(O)-G where Gel represents a gelatin polypeptide, -C(O)- is a carbonyl group from a free carboxyl moiety of an aspartic acid or a glutamic acid component in the polypeptide, and G is a substituent which is free from groups having a pKa of from 3 to 8, and (b) the silver halide grain nuclei are grown at a pH in the range of from 3.0 to 8.0.

A primary feature of the invention is the recognition of the impact of the pH sensitivity of free carboxy groups of gelatin polypeptides upon the resulting robustness of the high bromide tabular grain preparation process.

Further aspects of the invention can be appreciated by reference to the following detailed description, including the Examples containing emulsions prepared in accordance with the invention.

DESCRIPTION OF PREFERRED EMBODIMENTS

The process of the invention can be employed to prepare relatively monodisperse high bromide tabular grain emulsions comprising tabular grains which account for a high percentage of the total grain projected area of the type described in the patents of Tsaur et al, Kim et al and Fenton et al, cited above and here incorporated by reference, by using a modified gelatin in the dispersing medium during the precipitation processes. More specifically this invention is directed towards the preparation of photographic emulsions having silver halide grains including tabular grains containing greater than 50 mole percent bromide, based on silver, and accounting for greater than 90 percent of total grain projected area. The coefficient of variation (COV) of grain mean equivalent circular diameter (ECD), based on total grains, for such emulsions is preferably less than 40 percent.

The first step in the preparation of tabular silver halide emulsions in accordance with the invention is to form within a dispersing medium containing a polyalkylene oxide block copolymer surfactant and gelatin a population of silver halide grain nuclei containing twin planes. The grain nuclei preferably consist essentially of silver bromide. The first step is followed by the step of growing the silver halide grain nuclei containing twin planes to form the desired tabular grain population.

As fully described by Tsaur et al, Kim et al and Fenton et al, to achieve the lowest possible grain dispersities the first step of formation the silver halide grain nuclei is performed under conditions that promote uniformity. The balanced double jet precipitation of grain nuclei is specifically contemplated in which an aqueous silver salt solution and an aqueous bromide salt are concurrently introduced into an aqueous dispersing medium containing water and a gelatino peptizer. Although one or both of chloride and iodide salts can be introduced to the dispersing medium along with silver through the bromide jet or as a separate aqueous solution through a separate jet, halide ions in the dispersing medium should consist essentially of bromide ions prior to introducing silver. While chloride and/or iodide can be incorporated during formation of the grain nuclei in any concentration taught by Tsaur et al, Kim et al or Fenton et al, it is preferred to minimize or eliminate chloride and/or iodide concentrations during grain nucleation. Silver nitrate is the most commonly utilized silver salt while the halide salts most commonly employed are ammonium halides and alkali metal (e.g., lithium, sodium or potassium) halides. When an ammonium counter ion is employed an acid pH——i.e., less than 7.0, is employed to avoid ammonia ripening of the grain nuclei as they are being formed.

Instead of introducing aqueous silver and halide salts through separate jets a uniform nucleation can be achieved by introducing a Lippmann emulsion into the dispersing medium. Since the Lippmann emulsion grains typically have a mean ECD of less than 0.05 $\mu$m, a small fraction of the Lippmann grains initially introduced serve as deposition sites while all of the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048.

To reduce the dispersity of the grain nuclei as they are formed and thereby dramatically lower the COV of the final grain population produced by precipitation, a polyalkylene oxide block copolymer surfactant is employed during formation of the grain nuclei. Polyalkylene oxide block copolymer surfactants generally and those contemplated for use in preparing the emulsions of this invention in particular are well known and have been widely used for a variety of purposes. They are generally recognized to constitute a major category of nonionic surfactants. For a molecule to function as a surfactant it must contain at least one hydrophilic unit and at least one lipophilic unit linked together. A general review of block copolymer surfactants is provided by I. R. Schmolka, "A Review of Block Polymer Surfactants", J. Am. Oil Chem. Soc., Vol. 54, No. 3, 1977, pp. 110–116, and A. S. Davidsohn and B. Milwidsky, *Synthetic Detergents*, John Wiley & Sons, N.Y. 1987, pp. 29–40, and particularly pp. 34–36.

One category of polyalkylene oxide block copolymer surfactant found to be useful in the preparation of the emulsions is comprised of two terminal lipophilic alkylene oxide block units linked by a hydrophilic alkylene oxide block unit accounting for at least 4 percent of the molecular weight of the copolymer. These surfactants are hereinafter referred to category S-I surfactants.

The category S-I surfactants contain at least two terminal lipophilic alkylene oxide block units linked by a hydrophilic alkylene oxide block unit and can be, in a simple form, schematically represented as indicated by diagram I below:

(I)

| | | |
|---|---|---|
| LAO1 | HAO1 | LAO1 |

where

LAO1 in each occurrence represents a terminal lipophilic alkylene oxide block unit and HAO1 represents a linking hydrophilic alkylene oxide block unit.

It is generally preferred that HAO1 be chosen so that the hydrophilic block unit constitutes from 4 to 96 percent of the block copolymer on a total weight basis.

It is, of course, recognized that the block diagram I above is only one example of a polyalkylene oxide block copolymer having at least two terminal lipophilic block units linked by a hydrophilic block unit. In a common variant structure interposing a trivalent amine linking group in the polyalkylene oxide chain at one or both of the interfaces of the LAO1 and HAO1 block units can result in three or four terminal lipophilic groups.

In their simplest possible form the category S-I polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula II:

(II)

$$HO-(\overset{CH_3}{\overset{|}{C}}HCH_2O)_x-(CH_2CH_2O)_y-(CH_2\overset{CH_3}{\overset{|}{C}}HO)_{x'}-H$$

where x and x' are each at least 6 and can range up to 120 or more and y is chosen so that the ethylene oxide block unit maintains the necessary balance of lipophilic and hydrophilic qualities necessary to retain surfactant activity. It is generally preferred that y be chosen so that the hydrophilic block unit constitutes from 4 to 96 percent by weight of the total block copolymer. Within the above ranges for x and x', y can range from 2 to 300 or more.

Generally any category S-I surfactant block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 16,000, preferably less than about 10,000, are contemplated for use.

In a second category, hereinafter referred to as category S-II surfactants, the polyalkylene oxide block copolymer surfactants contain two terminal hydrophilic alkylene oxide block units linked by a lipophilic alkylene oxide block unit and can be, in a simple form, schematically represented as indicated by diagram III below:

(III)

| | | |
|---|---|---|
| HAO2 | LAO2 | HAO2 |

where

HAO2 in each occurrence represents a terminal hydrophilic alkylene oxide block unit and LAO2 represents a linking lipophilic alkylene oxide block unit. It is generally preferred that LAO2 be chosen so that the lipophilic block unit constitutes from 4 to 96 percent of the block copolymer on a total weight basis.

It is, of course, recognized that the block diagram III above is only one example of a category S-II polyalkylene oxide block copolymer having at least two terminal hydrophilic block units linked by a lipophilic block unit. In a common variant structure interposing a trivalent amine linking group in the polyakylene oxide chain at one or both of the interfaces of the LAO2 and HAO2 block units can result in three or four terminal hydrophilic groups.

In their simplest possible form the category S-II polyalkylene oxide block copolymer surfactants are formed by first condensing 1,2-propylene glycol and 1,2-propylene oxide to form an oligomeric or polymeric block repeating unit that serves as the lipophilic block unit and then completing the reaction using ethylene oxide. Ethylene oxide is added to each end of the 1,2-propylene oxide block unit. At least thirteen (13) 1,2-propylene oxide repeating units are required to produce a lipophilic block repeating unit. The resulting polyalkylene oxide block copolymer surfactant can be represented by formula IV:

(IV)

$$HO-(CH_2CH_2O)_y-(\overset{CH_3}{\overset{|}{C}}HCH_2O)_x-(CH_2CH_2O)_y-H$$

where x is at least 13 and can range up to 490 or more and y and y' are chosen so that the ethylene oxide block units maintain the necessary balance of lipophilic and hydrophilic qualities necessary to retain surfactant activity. It is generally preferred that x be chosen so that the lipophilic block unit constitutes from 4 to 96 percent by weight of the total block copolymer; thus, within the above range for x, y and y' can range from 1 to 320 or more.

Any category S-II block copolymer surfactant that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 30,000, preferably less than about 20,000, are contemplated for use.

In a third category, hereinafter referred to as category S-III surfactants, the polyalkylene oxide surfactants contain at least three terminal hydrophilic alkylene oxide block units linked through a lipophilic alkylene oxide block linking unit and can be, in a simple form, schematically represented as indicated by formula V below:

$$(\text{H-HAO3})_z\text{-LOL-}(\text{HAO3-H})_{z'} \quad \text{(V)}$$

where

HAO3 in each occurrence represents a terminal hydrophilic alkylene oxide block unit, LOL represents a lipophilic alkylene oxide block linking unit, z is 2 and z' is 1 or 2.

The polyalkylene oxide block copolymer surfactants employed can take the form shown in formula VI:

$$(\text{H-HAO3-LAO3})_z\text{-L-}(\text{LAO3-HAO3-H})_{z'} \quad \text{(VI)}$$

where

HAO3 in each occurrence represents a terminal hydrophilic alkylene oxide block unit, LAO3 in each occurrence represents a lipophilic alkylene oxide block unit, L represents a linking group, such as amine or diamine, z is 2 and z' is 1 or 2.

The linking group L can take any convenient form. It is generally preferred to choose a linking group that is itself lipophilic. When z+z' equal three, the linking group must be trivalent. Amines can be used as trivalent linking groups. When an amine is used to form the linking unit L, the polyalkylene oxide block copolymer surfactants employed can take the form shown in formula VII:

(VII)

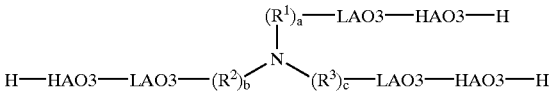

where

HAO3 and LAO3 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula VII.

When z+z' equal four, the linking group must be tetravalent. Diamines are preferred tetravalent linking groups. When a diamine is used to form the linking unit L, the polyalkylene oxide block copolymer surfactants employed can take the form shown in formula VIII:

(VIII)

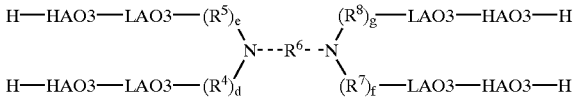

where

HAO3 and LAO3 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1. It is generally preferred that LAO3 be chosen so that the LOL lipophilic block unit accounts for from 4 to less than 96 percent, preferably from 15 to 95 percent, optimally 20 to 90 percent, of the molecular weight of the copolymer.

In a fourth category, hereinafter referred to as category S-IV surfactants, the polyalkylene oxide block copolymer surfactants employed contain at least three terminal lipophilic alkylene oxide block units linked through a hydrophilic alkylene oxide block linking unit and can be, in a simple form, schematically represented as indicated by formula IX below:

$$(\text{H-LAO4})_z\text{-HOL-}(\text{LAO4-H})_{z'} \quad \text{(IX)}$$

where

LAO4 in each occurrence represents a terminal lipophilic alkylene oxide block unit, HOL represents a hydrophilic alkylene oxide block linking unit, z is 2and z' is 1 or 2.

The polyalkylene oxide block copolymer surfactants employed can take the form shown in formula X:

$$(\text{H-LAO4-HAO4})_z\text{-L'-}(\text{HAO4-LAO4-H})_{z'} \quad \text{(X)}$$

where

HAO4 in each occurrence represents a hydrophilic alkylene oxide block unit,

LAO4 in each occurrence represents a terminal lipophilic alkylene oxide block unit, L' represents a linking group, such as amine or diamine, z is 2 and z' is 1 or 2.

The linking group L' can take any convenient form. It is generally preferred to choose a linking group that is itself hydrophilic. When z+z' equal three, the linking group must be trivalent. Amines can be used as trivalent linking groups. When an amine is used to form the linking unit L', the polyalkylene oxide block copolymer surfactants employed can take the form shown in formula XI:

(XI)

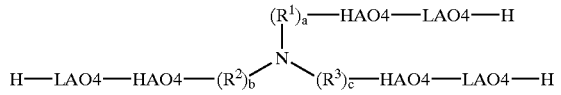

where

HAO04 and LAO4 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1. To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XI.

When z+z' equal four, the linking group must be tetravalent. Diamines are preferred tetravalent linking groups. When a diamine is used to form the linking unit L', the polyalkylene oxide block copolymer surfactants employed can take the form shown in formula XII:

(XII)

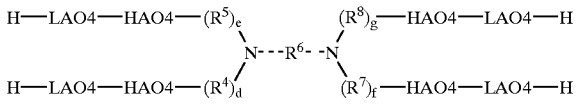

where

HAO4 and LAO4 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1. It is generally preferred that LAO4 be chosen so that the HOL hydrophilic block unit accounts for from 4 to 96 percent, preferably from 5 to 85 percent, of the molecular weight of the copolymer.

In their simplest possible form the polyalkylene oxide block copolymer surfactants of categories S-III and S-IV employ ethylene oxide repeating units to form the hydrophilic (HAO3 and HAO4) block units and 1,2- propylene oxide repeating units to form the lipophilic (LAO3 and LAO4) block units. At least three propylene oxide repeating units are required to produce a lipophilic block repeating unit. When so formed, each H-HAO3-LAO3- or H-LAO4-HA04- group satisfies formula XIII*a* or XIII*b*, respectively:

(XIIIa)

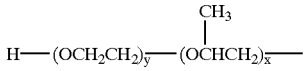

(XIIIb)

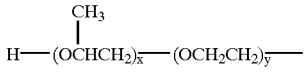

where x is at least 3 and can range up to 250 or more and y is chosen so that the ethylene oxide block unit maintains the necessary balance of lipophilic and hydrophilic qualities necessary to retain surfactant activity. This allows y to be chosen so that the hydrophilic block units together constitute from greater than 4 to 96 percent (optimally 10 to 80 percent) by weight of the total block copolymer. In this instance the lipophilic alkylene oxide block linking unit, which includes the 1,2-propylene oxide repeating units and the linking moieties, constitutes from 4 to 96 percent (optimally 20 to 90 percent) of the total weight of the block copolymer. Within the above ranges, y can range from 1 (preferably 2) to 340 or more.

The overall molecular weight of the polyalkylene oxide block copolymer surfactants of categories S-III and S-IV have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general category S-III surfactants having molecular weights of less than about 60,000, preferably less than about 40,000, are contemplated for use, category S-IV surfactants having molecular weight of less than 50,000, preferably less than about 30,000, are contemplated for use.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted in any of the category S-I, S-II, S-III and S-IV surfactants, provided the intended lipophilic and hydrophilic properties are retained. For example, the propylene oxide repeating unit is only one of a family of repeating units that can be illustrated by formula XIV (XIV)

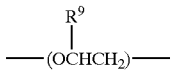

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula XV:

(XV)

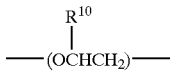

where $R^{10}$ is hydrogen or a hydrophilic group, such as a hydrocarbon group of the type forming $R^9$ above additionally having one or more polar substituents——e.g., one, two, three or more hydroxy and/or carboxy groups.

In each of the surfactant categories each of block units contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting suitable surfactants.

Only very low levels of surfactant are required in the emulsion at the time parallel twin planes are being introduced in the grain nuclei to reduce the grain dispersity of the emulsion being formed. Surfactant weight concentrations are contemplated as low as 0.1 percent, based on the interim weight of silver--that is, the weight of silver present in the emulsion while twin planes are being introduced in the grain nuclei. A preferred minimum surfactant concentration is 1 percent, based on the interim weight of silver. A broad range of surfactant concentrations have been observed to be effective. No further advantage has been realized for increasing surfactant weight concentrations above 100 percent of the interim weight of silver using category S-I surfactants or above 50 percent of the interim weight of silver using category S-II, S-III or S-IV surfactants. However, surfactant concentrations of 200 percent of the interim weight of silver or more are considered feasible using category S-I surfactants or 100 percent or more using category S-II, S-III or S-IV surfactants.

The preparation process is compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step. In other words, grain nucleation occurs under conditions that are conducive to twinning. The second approach is to form a stable grain nuclei population and then adjust the pAg of the interim emulsion to a level conducive to twinning.

Regardless of which approach is employed, it is advantageous to introduce the twin planes in the grain nuclei at an early stage of precipitation. It is contemplated to obtain a grain nuclei population containing parallel twin planes using less than 2 percent of the total silver used to form the tabular grain emulsion. It is usually convenient to use at least 0.05 percent of the total silver to form the parallel twin plane containing grain nuclei population, although this can be accomplished using even less of the total silver. The longer introduction of parallel twin planes is delayed after forming a stable grain nuclei population the greater is the tendency toward increased grain dispersity.

At the stage of introducing parallel twin planes in the grain nuclei, either during initial formation of the grain nuclei or immediately thereafter, the lowest attainable levels of grain dispersity in the completed emulsion are achieved by control of the dispersing medium. The pAg of the dispersing medium is preferably maintained in the range of from 5.4 to 10.3 and, for achieving a COV of less than 10 percent, optimally in the range of from 7.0 to 10.0. At a pAg of greater than 10.3 a tendency toward increased tabular grain ECD and thickness dispersities is observed. Any convenient conventional technique for monitoring and regulating pAg can be employed. During grain nucleation the pH of the dispersing medium is preferably maintained at less than 6.0 at the time parallel twin planes are being introduced to lower grain dispersity.

The formation of grain nuclei containing parallel twin planes is undertaken at conventional precipitation temperatures for photographic emulsions, with temperatures in the range of from 20 to 80° C. being particularly preferred and temperature of from 20 to 60° C. being optimum.

Once a population of grain nuclei containing parallel twin planes has been established as described above, preferably the next step is to reduce the dispersity of the grain nuclei population by ripening. The objective of ripening grain nuclei containing parallel twin planes to reduce dispersity is disclosed by both Himmelwright U.S. Pat. No. 4,477,565 and Nottorf U.S. Pat. No. 4,722,886, the disclosures of which are here incorporated by reference. Ammonia and thioethers in concentrations of from about 0.01 to 0.1 N constitute preferred ripening agent selections.

Instead of introducing a silver halide solvent to induce ripening it is possible to accomplish the ripening step by adjusting pH to a high level——e.g., greater than 9.0. A ripening process of this type is disclosed by Buntaine and Brady U.S. Pat. No. 5,013,641. In this process the post nucleation ripening step is performed by adjusting the pH of the dispersing medium to greater than 9.0 by the use of a base, such as an alkali hydroxide (e.g., lithium, sodium or potassium hydroxide) followed by digestion for a short period (typically 3 to 7 minutes). At the end of the ripening step the emulsion is again returned to the acidic pH ranges conventionally chosen for silver halide precipitation (e.g. less than 6.0) by introducing a conventional acidifying agent, such as a mineral acid (e.g., nitric acid).

Some reduction in dispersity will occur no matter how abbreviated the period of ripening. It is preferred to continue ripening until at least about 20 percent of the total silver has been solubilized and redeposited on the remaining grain nuclei. The longer ripening is extended the fewer will be the number of surviving nuclei. This means that progressively less additional silver halide precipitation is required to produce tabular grains of an aim ECD in a subsequent growth step. Looked at another way, extending ripening decreases the size of the emulsion make in terms of total grams of silver precipitated. Optimum ripening will vary as a function of aim emulsion requirements and can be adjusted as desired.

Once nucleation and ripening have been completed, further growth of the emulsions can be undertaken in any conventional manner consistent with achieving desired final mean grain thicknesses and ECDs. The halides introduced during grain growth can be selected independently of the halide selections for nucleation. The tabular grain emulsion can contain grains of either uniform or nonuniform silver halide composition.

In optimizing the process of preparation for minimum tabular grain dispersity levels it has been observed that optimizations differ as a function of iodide incorporation in the grains as well as the choices of surfactants and/or peptizers.

Gelatino-peptizers employed during emulsion grain precipitation may be based upon any conventional gelatins. Peptizer concentrations of from 20 to 800 (optimally 40 to 600) grams per mole of silver introduced during the nucleation step have been observed to produce emulsions of the lowest grain dispersity levels. Gelatino-peptizers are commonly divided into so-called "regular" gelatino-peptizers and so-called "oxidized" gelatino-peptizers. Regular gelatino-peptizers are those that contain naturally occurring amounts of methionine of at least 30 micromoles of methionine per gram and usually considerably higher concentrations. The term oxidized gelatino-peptizer refers to gelatino-peptizers that contain less than 30 micromoles of methionine per gram. A regular gelatino-peptizer is converted to an oxidized gelatino-peptizer when treated with a strong oxidizing agent, such as taught by Maskasky U.S. Pat. No. 4,713,323 and King et al U.S. Pat. No. 4,942,120, the disclosures of which are here incorporated by reference. The oxidizing agent attacks the divalent sulfur atom of the methionine moiety, converting it to a tetravalent or, preferably, hexavalent form. While methionine concentrations of less than 30 micromoles per gram have been found to provide oxidized gelatino-peptizer performance characteristics, it is preferred to reduce methionine concentrations to less than 12 micromoles per gram. Any efficient oxidation will generally reduce methionine to less than detectable levels. Since gelatin in rare instances naturally contains low levels of methionine, it is recognized that the terms "regular" and "oxidized" are used for convenience of expression while the true distinguishing feature is methionine level rather than whether or not an oxidation step has been performed.

It has been discovered that, although polyalkylene oxide block copolymer surfactants play an essential role in producing relatively monodisperse grain populations comprising high percentages projected area accounted for by tabular grains, the presence of the surfactant in combination with conventional gelatins containing only unmodified free carboxy groups during grain growth renders the emulsions susceptible to batch to batch variations in grain mean ECD and mean thickness, even when the pH of grain growth is maintained within conventional ranges——e.g., in the customary range of from 3.0 to 8.0. In accordance with the invention, the robustness of the emulsion preparation process can be increased (i.e., batch to batch variations in grain mean ECD and mean thickness can be reduced) by conducting grain growth in the presence of a gelatin which has been modified to convert at least one of the carboxylic acid groups thereof to a group that does not exhibit pH-dependent ionization within the pH range from 4.0 to 7.0. In accordance with a further advantage of the invention, the physical properties of gelatin, such as isoelectric point and shear modulus may be varied appreciably. As a result of this modification, it is possible to synthesize modified gelatin that has very low G' values, which should enable the use of such materials in emulsion precipitation processes at a much lower temperatures than possible with unmodified gelatin.

Gelatin Modification Procedure:

As generally known to those skilled in the art gelatin is prepared from collagen. Details on the preparation of gelatin are described in, e.g., "the Science and Technology of Gelatin" A. G. Ward and A. Courts, Academic Press 1977, p. 295. Gelatin consists of a three-dimensional network of polypeptide chains. Each polypeptide chain is built-up by repeating units of about twenty different amino acids linked together by peptide bonds. The dicarboxylic amino acids, i.e. aspartic acid and glutamic acid, provide the free (unbonded) carboxyl groups in the polypeptide chain, while the free amino groups are provided by amino acids containing more than one amino group, e.g. lysine and arginine. Free carboxylic groups and free amino groups can act as so-called functional groups in several chemical reactions, e.g. modification reactions and hardening reactions. The ratio of free carboxylic and free amino groups determines the so-called isoelectric point, the pH at which the gelatin molecule is electrically neutral.

Scientific and patent literature is replete with references concerning gelatin modifications chemically applied on the free primary amino functions. For instance, different types of acylated gelatins are disclosed in U.S. Pat. No. 2,525,753, 2,827,419, 3,486,896 and 3,763,138. Phthaloyl gelatins are described in U.S. Pat. No. 2,725,293 and BE 840,437. Reaction of gelatin with compounds containing active halogen atoms are disclosed in BE 614,426 and BE 1,005,787. Disclosures concerning modifications of the free carboxyl groups of gelatin, on the other hand, are relatively scarce.

In U.S. Pat. No. 4,238,480 different reagents, including among others ethylenediamine, are used to modify collagen into a substance with a more electropositive surface, which is used as a hemostatic agent. In U.S. Pat. No. 4,572,837, the preparation of basic proteins from acidic proteins for use in edible food products is described wherein at least some of the acidic, negatively charged amino acid residues of the protein are neutralized by attaching a nucleophile group to the carboxyl group, thus increasing the isoelectric point. The nucleophilic group may contain basic nitrogen and be attached by means of an amide linkage. The group may be provided by a neutral or basic amino acid ester, an amino sugar or ammonium ion. One disclosed method of attaching the nucleophilic group to the carboxyl group comprises reacting the protein with a carbodi-imide and causing the adduct so formed to react with a nucleophilic reagent to displace the carbodi-imide group.

In U.S. Pat. No. 5,219,992, a gelatin for use in photographic elements is disclosed which is modified by reaction on part of the free carboxyl groups in the presence of (i) an amide bond forming agent and (ii) a well-defined type of diamine, triamine or cyclic diamine, e.g. piperazine. In this way additional end-standing amino functions were introduced in the gelatin molecule, which, moreover, proved to be more reactive to vinylsulphonyl hardeners, a common type of hardeners for gelatin, than the original ones. In this way multilayer photographic elements can be designed which show so-called differential hardness. U.S. Pat. No. 5,439,791 discloses carboxyl group modified gelatin wherein end-standing amino, sulphinic acid or thio groups are introduced and their use in photographic elements for the similar purpose as in U.S. Pat. No. 5,219,992 of providing differentially hardened layers. In U.S. Pat. No. 5,391,477, carboxylic groups of gelatin polypeptide chains are similarly modified to form amide linkages to provide a modified gelatin for use in photographic elements, with the disclosed feature of decreased propensity for water absorption upon processing without loss of sensitometric properties. In U.S. Pat. Nos. 5,474,885 and 5,536,817, the use of gelatin modified to replace part of the free carboxyl groups thereof with more acid end-standing groups to provide more hydrophilic character in silver complex diffusion transfer reversal process (DTR) photographic materials is disclosed.

The free carboxy group modified gelatins described in the above patents may be used in the preparation of tabular grain emulsions in accordance with the instant invention, to the extent the modified groups do not contain functional groups which exhibit pH-dependent ionization within the pH range from 4.0 to 7.0, and the modification procedures described therein are incorporated herein by reference. Modified gelatin for use in accordance with the invention may be prepared, e.g., by activating free carboxy groups thereof with amide or ester forming agents in the presence of mono-functional amines, alcohols or thiols as the nucleophiles. The result is a conversion of some of the free carboxyl groups in the gelatin into amide, ester or thioester, thereby reducing the content of the pH-sensitive carboxylic acids in the gelatin. The iso-electric point of the gelatin is thus shifted to higher pH values depending on the extent of conversion. While the conversion of any fraction of the free carboxylic acid groups in a modified gelatin in accordance with the invention will be useful, in preferred embodiments at least 10 percent, and more preferably at least 30 percent of the free carboxylic acid groups are modified to not contain functional groups which exhibit pH-dependent ionization within the pH range from 4.0 to 7.0.

In a specific embodiment of the invention, the modified gelatin may be represented by the formula Gel-C(O)-G where Gel represents a gelatin polypeptide, -C(O)- is a carbonyl group from a free carboxyl moiety of an aspartic acid or a glutamic acid component in the polypeptide, and G is a substituent which is free from functional groups having a pKa of from 3 to 8.

The pKa values of various functional groups are well known and can typically be ascertained from published literature, such as those reported by *The Handbook of Chemistry Physics,* 54th Ed., CRC Press, Cleveland, Oh. Multifunctional acids, those capable of releasing more than one hydrogen ion, have a different pKa value for each hydrogen ion capable of being released.

Functional groups having a pKa of less than 3 or greater than 8 may be present in substituent G. In preferred embodiments, however, to provide even further robust performance, substituent G is free of functional groups having a pKa in the range of from 2 to 10. In a particularly preferred embodiment, the invention relates to emulsion which have been precipitated in the presence of gelatin for which at least a portion of the free carboxylic acid groups thereof have been chemically modified to provide functional groups having a pKa above 10 (i.e., functional groups that do not exhibit a pH-dependent ionization at pH values of less than 10, such as hydroxyl (-OH)), or more strongly acidic (relative to carboxylic acid) functional groups having a pKa of less than 2 (i.e., functional groups that do not exhibit a pH-dependent ionization at pH values of above 2, such as $-SO_3H$ groups), or moieties such as imidazole which exhibit enhanced silver ion binding.

Modified gelatins of the above formula may preferably be represented wherein -G is represented by -(Y)mL-IG, where Y represents -S-, -O- or -NH-; m=0 or 1; L is a further substituted or unsubstituted linking group, such as alkylene (e.g., ethylene, isopropylene), polyalkyleneoxide (e.g., polyethyleneoxide, polyethyleneglycol), polyalkylenehydroxy (e.g., polyvinylalcohol), unsaturated rings (e.g., cyclohexyl), aromatic rings (e.g., benzyl), or heterocyclic groups (e.g., furan or thiophene); and IG is a group that has pKa below 3 or pKa above 8 (e.g., phosphate, phosphonate, sulfonate, sulfinate, seleninate, phenolate, hydroxamate, morpholine, dimethylamine, methylimidazole, aminopyridine, sulfonamide, or aliphatic, aromatic, and heterocyclic alcohols).

In preferred embodiments of the invention, a modified gelatin of the above formula is employed where G represents $-NR_1R_2$, wherein $R_1$ and $R_2$ each independently represent hydrogen or substituted or unsubstituted alkyl, aryl, arylalkyl, or hetrocylclic groups, or $R_1$ and $R_2$ together form a ring, particularly wherein $R_1$ represents a hydroxy substituted alky, aryl, arylalkyl, or hetrocylclic group, and wherein $R_2$ represents hydrogen. More particularly preferred is wherein $R_1$ represents a hydroxy substituted alkyl group of from 1 to 10 carbons, e.g. a hydroxyethyl group.

In addition to the above specifically referenced terminal functional group containing moieties, other nucleophiles may also used for similar modification at the carboxylate site of the gelatin. Examples of additional possible nucleophiles include: Polyethylene glycol, such as PEG-200, 300, 400, and 600; Triethylene glycol; Jeffamine M-715 from Texaco (polyoxyalkylene monoamine); 2-(2-aminoethoxy)ethanol; D-Glucosamine; 1-(3-aminopropyl)-2-pyrrolidinone; 2-amino-2-thiazoline; 3, 6-dithia-1,8-octanediol; Taurine (2-aminoethanesulfonic acid)- this derivative has the advantage that the isoelectric point is not altered and the sulfonated terminal group is not sensitive to pH; Other diamines, such as ethylenediamine, Jeffamines EDR-148, EDR- 192, 1-(2-aminoethyl)piperazine.

When a free carboxy group modified "regular" (i.e., non-oxidized) gelatin and a category S-I surfactant are each employed prior to post-ripening grain growth, the category S-I surfactant is preferably selected so that the hydrophilic block (e.g., HAO1) accounts for 4 to 96 (preferably 5 to 85 and optimally 10 to 80) percent of the total surfactant molecular weight. It is preferred that x and x' (in formula II) be at least 6 and that the minimum molecular weight of the surfactant be at least 760 and optimally at least 1000, with maximum molecular weights ranging up to 16,000, but preferably being less than 10,000.

When the category S-I surfactant is replaced by a category S-II surfactant, the latter is preferably selected so that the lipophilic block (e.g., LAO2) accounts for 4 to 96 (preferably 15 to 95 and optimally 20 to 90) percent of the total surfactant molecular weight. It is preferred that x (formula IV) be at least 13 and that the minimum molecular weight of the surfactant be at least 800 and optimally at least 1000, with maximum molecular weights ranging up to 30,000, but preferably being less than 20,000.

When a category S-III surfactant is selected for this step, it is preferably selected so that the lipophilic alkylene oxide block linking unit (LOL) accounts for 4 to 96 percent, preferably 15 to 95 percent, and optimally 20 to 90 percent of the total surfactant molecular weight. In the ethylene oxide and 1,2-propylene oxide forms shown in formula (XIIIa), x can range from 3 to 250 and y can range from 2 to 340 and the minimum molecular weight of the surfactant is greater than 1,100 and optimally at least 2,000, with maximum molecular weights ranging up to 60,000, but preferably being less than 40,000. The concentration levels of surfactant are preferably restricted as iodide levels are increased.

When a category S-IV surfactant is selected for this step, it is preferably selected so that the hydrophilic alkalylene oxide block linking unit (HOL) accounts for 4 to 96 percent, preferably 5 to 85 percent, and optimally 10 to 80 percent of the total surfactant molecular weight. In the ethylene oxide and 1,2-propylene oxide forms shown in formula (XIIb), x can range from 3 to 250 and y can range from 2 to 340 and the minimum molecular weight of surfactant is greater than 1,100 and optimally at least 2,000, with maximum molecular weights ranging up to 50,000, but preferably being less than 30,000.

When a free carboxy group modified oxidized gelatinopeptizer is employed prior to post-ripening grain growth and no iodide is added during post- ripening grain growth, minimum COV emulsions can be prepared with category S-I surfactants chosen so that the hydrophilic block (e.g., HAO1) accounts for 4 to 35 (optimally 10 to 30) percent of the total surfactant molecular weight. The minimum molecular weight of the surfactant continues to be determined by the minimum values of x and x' (formula II) of 6. In optimized forms x and x' (formula II) are at least 7. Minimum COV emulsions can be prepared with category S-II surfactants chosen so that the lipophilic block (e.g., LAO2) accounts for 40 to 96 (optimally 60 to 90) percent of the total surfactant molecular weight. The minimum molecular weight of the surfactant continues to be determined by the minimum value of x (formula IV) of 13. The same molecular weight ranges for both category S-I and S-II surfactants are applicable as in using "regular" gelatinopeptizer as described above.

The polyalkylene oxide block copolymer surfactant can, if desired, be removed from the emulsion after it has been fully prepared. Any convenient conventional washing procedure, such as those illustrated by *Research Disclosure*, Vol. 389, Sep. 1996, Item 38957, Section III, can be employed. The polyalkylene oxide block copolymer surfactant constitutes a detectable component of the final emulsion when present in concentrations greater than 0.02 percent, based on the total weight of silver.

The photographic emulsions, once formed in accordance with this invention, can be sensitized, combined with other photographic addenda, and incorporated into photographic elements in any convenient conventional manner, as illustrated by *Research Disclosure*, Item 38957, cited above, noting particularly the following sections:

IV. Chemical sensitization;

V. Spectral sensitization a. Sensitizing dyes;

VII. Antifoggants and stabilizers;

VIII. Absorbing and scattering materials;

IX. Coating and physical property modifying addenda;

X. Dye image formers and modifiers;

XI. Layers and layer arrangements;

XII. Features applicable only to color negative

XIII. Features applicable only to color positive

B. Color reversal

C. Color positives derived from color negatives; and

XIV. Scan facilitating features.

EXAMPLES

Samples of free carboxy group modified gelatin which may be used in accordance with the invention were prepared using pyridinium,2,2'-oxybis(1-methyl-bis(tetrafluoroborate))(PD-9, MW=375.87)as a water-soluble reagent to activate the carboxylic acids in the gelatin, and reaction with a nucleophile similarly as described in U.S. Pat. No. 5,219,992 incorporated by reference above.

The theoretical extent of conversion is determined by the molar ratio nucleophile reactant to free carboxyl groups of the starting gelatin, with a molar excess of nucleophile used where 100% modification is desired. The extent of conversion may be further estimated by $^{13}C$ NMR spectroscopy, wherein the amounts of glutamic and aspartic acid residues of the gelatin before and after modification are estimated by comparing the peak integrals. The acid carbonyl resonance shifts from above 179 ppm to below 179 ppm, e.g., upon modification with an amine.

The iso-electric point (PI) of the gelatin samples were determined as follows. The gelatin sample was first de-ionized with a mixed-bed ion-exchange resin. The gelatin (~5%) and resin mixture in water was heated to 50° C. for 1–2 hrs prior to filtration and freeze drying. The solid gelatin sample was then dissolved in water at 2–4 % and the ionic conductivity and pH measured. Generally an aqueous NaCl solution (0.1 N) of 0.2 g gelatin in 5 mL is titrated either with 0.1 N HCl or with 0.1 N NaOH to determine pH. The conductivity is very low to ensure that there is very little excess salt present. The pH is then taken as the PI for the gelatin sample.

Modified Gelatin Synthesis Example (1):

Modification with ethanolamine ($HO\text{-}CH_2CH_2\text{-}NH_2$)

To a solution of 60 g of gelatin (oxidized ossein bone) (~78 mmol in -COOH group) in 1.2 L water at 50° C. was added 10 times excess molar amount of ethanolamine (50 g) (i.e., theoretical 100% modification of free carboxyl groups). The pH of this mixture was adjusted with concentrated HCl to 5.2 with constant stirring. A slight molar excess of the activation reagent (PD-9) (35 g ~1.2×78 mmol) was added while maintaining the pH of the mixture to 5.2 over 1–2 hrs at 50° C. The solution was then dialyzed overnight and de-ionized with an adequate amount of MB-3 mixed bed ion-exchange resin prior to filtration and freeze dry (56 g solid modified gelatin collected). The pH for a 2 % solution was measured to be 9.5 (~taken as the isoelectric point), with an ionic conductivity of less than 10 $\mu$S/cm.

Various other extents of conversion were also performed to prepare additional samples by varying the molar ratio of ethanolamine to free carboxyl groups. The iso-electric points for various samples were about 5.5, 6.0, and 9.5 for theoretical 30, 50, and 100% modified gelatin samples, compared to an iso-electric point of 4.9 for un-modified oxidized ossein bone gelatin.

The actual extent of conversion was further estimated by $^{3}C$ NMR spectroscopy. The amounts of glutamic and aspartic acid residues of the gelatin before and after the ethanolamine modification were estimated by comparing the peak integrals. The acid carbonyl resonance shifted from above 179 ppm to below 179 ppm upon modification with the amine. The peak ratios yielded approximately 33% conversion for the theoretical 100% converted sample.

Modified Gelatin Synthesis Example (2):

Modification with 1-(3-aminopropyl)imidazole

To a solution of 20 g of gelatin (oxidized ossein bone) (~26 mmol in -COOH group) in 400 mL water at 50° C. was added 3 times excess molar amount of 1-(3-aminopropyl) imidazole (10 g) (i.e., theoretical 100% modification of free carboxyl groups). The pH of this mixture was adjusted with concentrated HCl to 5.2 with constant stirring. A slight molar excess of the activation reagent (PD-9) (12 g~1.2×26 mmol) was added while maintaining the pH of the mixture to 5.2 over 1–2 hrs at 50° C. The solution was then dialyzed overnight and de-ionized with an adequate amount of MB-3 mixed bed ion-exchange resin prior to filtration and freeze dry (yield: 56 g solid of modified gelatin). The pH for a 2 % solution was measured to be 8.6 (~isoelectric point) with an ionic conductivity of less than 8 $\mu$S/cm.

Various other extents of conversion were also performed to prepare additional samples by varying the molar ratio of 1-(3-aminopropyl) imidazole to free carboxyl groups. The iso-electric points for various imidazole-containing modified gelatin samples ranged from 5.3 to 8.8, compared to an iso-electric point of 4.9 for unmodified oxidized ossein bone gelatin.

Modified Gelatin Synthesis Example (3):

Modification with 4-(3-aminopropyl)morpholine

To a solution of 20 g of gelatin (oxidized ossein bone) (~26 mmol in -COOH group) in 500 mL water at 50° C. was added 4 times excess molar amount of 4-(3-aminopropyl) morpholine (15 g) (i.e., theoretical 100% modification of free carboxyl groups). The pH of this mixture was adjusted with concentrated HCl to 5.2 with constant stirring. A slight molar excess of the activation reagent (PD-9) (12 g ~1.2x26 mmol) was added while maintaining the pH of the mixture to 5.2 over 1–2 hrs at 50° C. The solution was then dialyzed overnight and de-ionized with an adequate amount of MB-3 mixed bed ion-exchange resin prior to filtration and freeze dry (yield: 56 g solid of modified gelatin). The pH for a 2 % solution was measured to be 9.55 (~ isoelectric point), with an ionic conductivity of less than 10 $\mu$S/cm. A second sample prepared similarly yielded an isoelectric point of 10.2, indicating a slightly higher actual conversion percentage.

Effect of Gelatin Modification on Silver Ion Complexation Behavior

Solutions containing 2% gelatin, 0.2 M $KNO_3$, and 1.2 mM $AgNO_3$ were held at 40° C. with stirring. The pH was adjusted incrementally with KOH solution while solution pH and pAg were monitored. The results in the following Table I show the silver ion complexation behavior of various modified gelatin samples obtained as described in the synthesis examples above, relative to unmodified oxidized ossein gelatin.

TABLE I

| Gelatin Modification Theoretical % | pAg @ pH = 3.5 | pAg @ pH = 5.5 | pAg @ pH = 9.5 |
|---|---|---|---|
| Un-modified | 3.4 | 3.5 | 5.5 |
| 30% ethanolamine | 3.4 | 3.5 | 5.3 |
| 100% ethanolamine | 3.4 | 3.5 | 5.4 |
| 15% imidazole | 3.4 | 3.6 | 5.7 |
| 100% imidazole | 3.4 | 3.9 | 6.3 |

These data show that modification of gelatin with ethanolamine in accordance with a preferred embodiment of the invention does not significantly alter the solution binding of silver ion in the range of from pH 3.5 to 9.5. Modification of gelatin with imidazole does not significantly influence silver ion binding at lower pH (e.g., below 5), but does slightly alter the silver binding properties at pH 5.5 to 9.5.

Emulsion Precipitation and Photographic Performance

The invention can be further appreciated by reference to the following specific embodiments. All of the emulsions were prepared in the presence of a polyalkylene oxide block copolymer surfactant to generate tabular grain emulsions, which in each instance comprised tabular grains accounting for greater than 90% of total grain projected area.

Emulsion Example 4

Step 1: A reactor charged with 1.5 liters of deionized water, 1.2 g of oxidized and chemically modified gelatin (100% theoretical ethanolamine modified gelatin prepared in accordance with Modified Gelatin Synthesis Example (1)), 3.21 g of sodium bromide and 3.6 ml of an aqueous solution containing 10% PLURONIC 31R1 polyalkylene oxide block copolymer surfactant (x=x'=25, y=7 in Formula II) and 1 % Alkanol XC surfactant was maintained at 40° C. The pH of the reactor is lowered by adding 7 ml of 4 M nitric acid. To this reactor 0.01 moles of silver nitrate (3.25 M in concentration) and sodium bromide (3.36 M in concentration) were added at a constant rate in 1 minute to precipitate AgBr nucleii, followed by the addition of 0.036 moles of the same sodium bromide solution at a constant addition rate in 3 minutes. The temperature of the reactor was increased to 57° C. in 12 minutes using a linear ramp. The reactor was then held at 57° C. for 10 minutes and 480 ml of an 82 g liter aqueous (oxidized and 100% theoretical ethanolamine modified) gelatin solution containing 0.45 ml of the aqueous solution of 10% PLURONIC 31R1 and 1% Alkanol XC was added, followed by the addition of 11 ml of a 2.5 M sodium hydroxide solution.

Step 2: The pH of the reactor was then adjusted to 4.5.

Step 3: To this reactor, 0.10 moles of the same silver nitrate solution and the same sodium bromide solution were added at a constant rate over 8 minutes, while the pBr of the reactor was maintained at 1.76. Then, 0.70 moles of the same silver nitrate and sodium bromide solutions were added using a linear ramp over a period of 20 minutes, with the starting flow rate being 3.6 ml/min and the reactor pBr being maintained at 1.76. Then, 0.78 moles of the same silver nitrate and sodium bromide solutions were added over a period of 10 minutes using another linear ramp with the initial flow rate being 18 ml/min, with the reactor pBr being maintained at 1.76. Another 3.41 moles of the same silver nitrate and sodium bromide solutions were added to the reactor over 35 minutes at a constant addition rate, the reactor pBr being maintained at 1.76.

Step 4: Then, 0.12 moles of the same silver nitrate and sodium bromide solutions were added using a linear ramp over a time of 1.2 minutes to increase the pBr of the reactor to 2.23.

Step 5: The emulsion was then cooled to 40° C. using a linear ramp in 4 minutes, and washed and concentrated using a phthalated gelatin induced coagulation procedure and additional oxidized gelatin was added to bring the gelatin concentration to 39.1 g/mole of silver halide in the emulsion. The pH and the pBr of the emulsion were adjusted to 5.3 and 2.17 respectively.

Emulsion Example 5:

Step 1: Same as in example 4.

Step 2: The pH of the reactor is then adjusted to 5.0.

Step 3: Same as in example 1 but the pBr of the reactor is maintained at 1.77.

Step 4: Same as in example 1 but the pBr of the reactor is increased to 2.23.

Step 5: Same as in example 1 but the pBr of the reactor is adjusted to 2.47.

Emulsion Example 6:

Step 1: Same as in example 4.

Step 2: The pH of the reactor was then adjusted to 5.5.

Step 3: Same as in example 1 but the pBr of the reactor was maintained at 1.75.

Step 4: Same as in example 1 but the pBr of the reactor was increased to 2.23.

Step 5: Same as in example 1 but the pBr of the reactor was adjusted to 2.55.

Emulsion Example 7:

Step 1: Same as in example 4.

Step 2: The pH of the reactor was then adjusted to 6.0.

Step 3: Same as in example 1 but the pBr of the reactor was maintained at 1.74.

Step 4: Same as in example 1 but the pBr of the reactor was increased to 2.23.

Step 5: Same as in example 1 but the pBr of the reactor was adjusted to 2.66.

Emulsion Example 8:

Step 1: Same as in example 4.

Step 2: The pH of the reactor was then adjusted to 4.0.

Step 3: Same as in example 1 but the pBr of the reactor was maintained at 1.68.

Step 4: Same as in example 1 but the pBr of the reactor was increased to 2.23.

Step 5: Same as in example 1 but the pBr of the reactor was adjusted to 2.65.

Emulsion Example 9:
Step 1: Same as in example 4.
Step 2: The pH of the reactor was then adjusted to 6.5.
Step 3: Same as in example 1 but the pBr of the reactor was maintained at 1.71.
Step 4: Same as in example 1 but the pBr of the reactor was increased to 2.23.
Step 5: Same as in example 1 but the pBr of the reactor was adjusted to 2.62.

Emulsion Example 10:
Step 1: Same as in example 4 except that the oxidized and chemically modified gelatin was replaced with oxidized gelatin without modified free carboxyl groups.
Step 2: The pH of the reactor was then adjusted to 4.0.
Step 3: Same as in example 1 but the pBr of the reactor was maintained at 1.71.
Step 4: Same as in example 1 but the pBr of the reactor was increased to 2.23.
Step 5: Same as in example 1 but the pBr of the reactor was adjusted to 2.48.

Emulsion Example 11:
Step 1: Same as in example 10.
Step 2: The pH of the reactor was then adjusted to 4.5.
Step 3: Same as in example 1 but the pBr of the reactor was maintained at 1.73.
Step 4: Same as in example 1 but the pBr of the reactor was increased to 2.23.
Step 5: Same as in example 1 but the pBr of the reactor was adjusted to 2.23.

Emulsion Example 12:
Step 1: Same as in example 10.
Step 2: The pH of the reactor was then adjusted to 5.0.
Step 3: Same as in example 1 but the pBr of the reactor was maintained at 1.76.
Step 4: Same as in example 1 but the pBr of the reactor was increased to 2.23.
Step 5: Same as in example 1 but the pBr of the reactor was adjusted to 2.55.

Emulsion Example 13:
Step 1: Same as in example 10.
Step 2: The pH of the reactor was then adjusted to 5.5.
Step 3: Same as in example 1 but the pBr of the reactor was maintained at 1.75.
Step 4: Same as in example 1 but the pBr of the reactor was increased to 2.23.
Step 5: Same as in example 1 but the pBr of the reactor was adjusted to 2.70.

Emulsion Example 14:
Step 1: Same as in example 10.
Step 2: The pH of the reactor was then adjusted to 6.0.
Step 3: Same as in example 1 but the pBr of the reactor was maintained at 1.73.
Step 4: Same as in example 1 but the pBr of the reactor was increased to 2.23.
Step 5: Same as in example 1 but the pBr of the reactor was adjusted to 2.71.

Emulsion Example 15:
Step 1: Same as in example 10.
Step 2: The pH of the reactor was then adjusted to 6.5.
Step 3: Same as in example 1 but the pBr of the reactor was maintained at 1.72.
Step 4: Same as in example 1 but the pBr of the reactor was increased to 2.23.
Step 5: Same as in example 1 but the pBr of the reactor was adjusted to 2.23.

The average equivalent circular diameter, COV and thickness of the emulsion grains obtained from these examples are listed in TABLE II.

TABLE II

| Emulsion Example | Carboxylic acid groups on gelatin chemically modified with ethanolamine? | pH | ECD in microns | COV | Thickness in microns |
|---|---|---|---|---|---|
| 8 | YES | 4.0 | 3.04 | 36.09 | 0.101 |
| 4 | YES | 4.5 | 3.30 | 38.28 | 0.082 |
| 5 | YES | 5.0 | 2.89 | 36.55 | 0.091 |
| 6 | YES | 5.5 | 2.94 | 39.09 | 0.091 |
| 7 | YES | 6.0 | 2.85 | 36.99 | 0.089 |
| 9 | YES | 6.5 | 2.64 | 38.31 | 0.098 |
| 10 | NO | 4.0 | 2.86 | 41.29 | 0.090 |
| 11 | NO | 4.5 | 2.95 | 39.99 | 0.088 |
| 12 | NO | 5.0 | 2.43 | 31.97 | 0.088 |
| 13 | NO | 5.5 | 1.90 | 25.43 | 0.110 |
| 14 | NO | 6.0 | 2.14 | 26.28 | 0.129 |
| 15 | NO | 6.5 | 2.42 | 26.86 | 0.135 |

The results in TABLE II clearly show that the emulsions precipitated with a modified gelatin in accordance with the invention are less sensitive to pH variation than the emulsions precipitated in gelatin that is not chemically modified. The emulsions from examples 5 and 10 (selected to have approximately equal average ECD and thickness) were further treated as shown in examples 16 and 17 and evaluated for their photographic properties.

EXAMPLE 16

To an 18 liter reactor containing 5 liters of deionized water at 60° C., 5.12 moles emulsion from example 5 and 0.22 moles of AgI fine grains (average grain size 06 micrometers) were added and the pH and the pBr of the reactor were adjusted to 5.54 and 1.72 respectively. Then, 2.15 moles of a 3.25 M silver nitrate solution and a 3.36 M sodium bromide solution were added to the reactor over 22 minutes at a constant addition rate. The reactor was then cooled to 40° C. over 20 minutes using a linear ramp and washed and concentrated using a phthalated gelatin induced coagulation procedure and the pH and pBr of the emulsion were adjusted to 5.45 and 2.69, respectively.

EXAMPLE 17

To an 18 liter reactor containing 5 liters of deionized water at 60° C., 5.12 moles of the emulsion from example 10 and 0.22 moles of AgI fine grains (average grain size 0.06 micrometers) were added and the pH and pBr of the reactor were adjusted to 5.50 and 1.72 respectively. Then, 2.15 moles of a 3.25 M silver nitrate solution and a 3.36 M sodium bromide solution were added to the reactor over 22 minutes at a constant addition rate. The reactor was then cooled to 40° C. over 20 minutes using a linear ramp and washed and concentrated using a phthalated gelatin induced coagulation procedure and the pH and pBr of the emulsion were adjusted to 5.60 and 3.32, respectively.

The equivalent circular diameter, COV and thickness of the emulsion grains obtained from these examples are listed in TABLE III.

TABLE III

| Example | Carboxylic acid groups on gelatin chemically modified with ethanolamine? | ECD in microns | COV | Thickness in microns |
|---|---|---|---|---|
| 16 | YES | 3.04 | 44.75 | 0.141 |
| 17 | NO | 3.00 | 44.45 | 0.142 |

Photographic Evaluation:

Emulsions examples 16 and 17 were separately treated in the following way (all materials added in units per mol silver halide). To the liquid emulsions at 40° C. were added 100 mg of Cpd-A, followed after 5 minutes by 45 mg of Cpd-B, followed after 5 minutes by 0.56 mmol of SS-A, followed after 20 minutes by 0.19 mmol of SS-B, followed after 20 minutes by 3 mg of CS-A, and followed after 5 minutes by 1.5 mg of CS-B. The emulsions were then heated to 60° C. and held for 10 minutes before cooling back to 40° C., following which was added 1.8 g of Cpd-C. The resulting sensitized emulsion samples were then mixed with additional water in preparation for coating. A secondary melt composed of gelatin, Cpd-C, an oil-in-water dispersion of Cpd-D, and conventional coating surfactants was mixed in equal volumes with the emulsion melt immediately before casting onto a cellulose triacetate support. This emulsion layer was then protected by a gelatin overlayer composed of coating surfactants and bis(vinylmethylsulfonyl)ether. The resulting dried coatings containing 120 mg Ag/ft$^2$, 475 mg gelatin/ft$^2$, and 90 mg Cpd-D/ft$^2$ were exposed for 0.01 seconds through a stepped density tablet and 0.3 density Inconel and Kodak Wratten 9 filters with 5500K light. Exposed strips were then processed for 2 minutes, 30 seconds using the Kodak Flexicolor™ C-41 color negative process.

Compound A (Cpd-A)=Sodium thiocyanate

Compound B (Cpd-B)=N-methylsulfamoylethyl benzothiazolium tetrafluoroborate

Compound C (Cpd-C)=4-Hydroxy- 1,3,3*a*,7-tetraazaindene

Compound D (Cpd-D)=

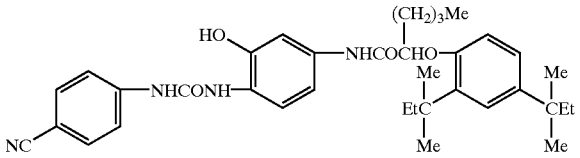

Chemical Sensitizer A (CS-A)=bis{2-[3-(2-sulfobenzamido)-phenyl]-mercaptotetrazolef}gold(I) tripotassium salt pentahydrate Chemical Sensitizer B (CS-B)=sodium carboxymethylrimethyl thiourea Spectral Sensitizing Dye A (SS-A)=Benzoxazolium, 5-chloro-2-[2-[[5-phenyl-3-(3-sulfobutyl) -2(3H)-benzoxazolylidene]methyl]- 1 -butenyl]-3-(3-sulfopropyl)-, inner salt, compd. with N,N-diethylethanamine Spectral Sensitizing Dye B (SS-B)=Benzoxazolium, 3-ethyl-2-[2-[[3-[2-( methylsulfonyl)amino]-2-oxoethyl]-2(3H)-benzothiazolylidene]methyl]-1-butenyl]-5-phenyl-, inner salt Densitometry provided a measure of the Dmin (defined as the optical transmissive density in the unexposed portion of the processed element), Gamma (defined as the maximum slope between any two adjacent density points induced by exposure), KSPD (defined as the exposure where the density above Dmin is 0.2 times the average gradient from that point to 0.6 log E greater exposure, and granularity (measured at approximately mid-scale points of equal density and reported in terms of gamma normalized rms granularity in grain units (GU). Normalizing gamma eliminates apparent granularity differences. For a discussion of granularity measurement techniques see H. C. Schmitt and J. H. Altman, Applied Optics, 9, pp. 871–874, Apr. 1970. The results of the photographic evaluation are shown in TABLE IV.

TABLE IV

| Emulsion Example | DMIN | KSPD | GAMMA | Granularity (GU) |
|---|---|---|---|---|
| 16 | 0.14 | 239 | 0.77 | 1.59 |
| 174 | 0.40 | 210 | 0.65 | 1.74 |

The invention has been described in detail with particular reference to preferred embodiments thereof, but it will be understood that variations and modifications can be effected within the spirit and scope of the invention.

What is claimed is:

1. A radiation-sensitive emulsion comprised of an aqueous dispersing medium and a coprecipitated grain population including tabular grains containing greater than 50 mole percent bromide, based on silver, having {111} major faces, and accounting for greater than 90 percent of total grain projected area, wherein said dispersing medium is comprised of (a) a gelatin which has been modified to convert at least one carboxylic acid group thereof to a group that does not exhibit pH-dependent ionization within the pH range from 4.0 to 7.0, and (b) a polyalkylene oxide block copolymer surfactant.

2. An emulsion according to claim 1, wherein the dispersing medium is comprised of a modified gelatin of the formula Gel-C(O)-G where Gel represents a gelatin polypeptide, -C(O)- is a carbonyl group from a free carboxyl moiety of an aspartic acid or a glutamic acid component in the polypeptide, and G is a substituent which is free from groups having a pKa of from 3 to 8.

3. An emulsion according to claim 2, where G represents —$NR_1R_2$, wherein $R_1$ and $R_2$ each independently represent hydrogen or substituted or unsubstituted alkyl, aryl, arylalkyl, or hetrocylclic groups, or $R_1$ and $R_2$ together form a ring.

4. An emulsion according to claim 3, wherein $R_1$ represents a hydroxy substituted alkyl, aryl, arylalkyl, or hetrocylclic group.

5. An emulsion according to claim 4, wherein $R_2$ represents hydrogen.

6. An emulsion according to claim 5, wherein $R_1$ represents a hydroxy substituted alkyl group of from 1 to 10 carbons.

7. An emulsion according to claim 6, wherein $R_1$ represents a hydroxyethyl group.

8. An emulsion according to claim 1 wherein the polyalkylene oxide block copolymer is selected from the group consisting of (1) LAO1-HAO1-LAO1 where

LAO1 in each occurrence represents a terminal lipophilic alkylene oxide block unit and HAO1 represents a hydrophilic alkylene oxide block linking unit, the HAO1 unit constitutes from 4 to 96 percent of the block copolymer on a weight basis, and the block copolymer has a molecular weight of from 760 to less than 16,000;

(2) HAO2-LAO2-HAO2 where

HAO2 in each occurrence represents a terminal hydrophilic alkylene oxide block unit and LAO2 represents a lipophilic alkylene oxide block linking unit, the LAO2 unit constitutes from 4 to 96 percent of the block copolymer on a weight basis, and the block copolymer has a molecular weight in the range of from 1,000 to of less than 30,000;

(3) $(H\text{-}HAO3)_z\text{-}LOL\text{-}(HAO3\text{-}H)_{z'}$ where

HAO3 in each occurrence represents a terminal hydrophilic alkylene oxide block unit, LOL represents a lipophilic alkylene oxide block linking unit, z is 2 and z' is 1 or 2, the LOL unit constitutes from 4 to 96 percent of the block copolymer on a weight basis, and the block copolymer has a molecular weight in the range of from greater than 1,100 to of less than 60,000; and (4) $(H\text{-}LAO4)_z\text{-}HOL\text{-}(LAO4\text{-}H)_{z'}$ where LAO4 in each occurrence represents a terminal lipophilic alkylene oxide block unit, HOL represents a hydrophilic alkylene oxide block linking unit, z is 2and z' is 1 or 2, the HOL unit constitutes from 4 to 96 percent of the block copolymer on a weight basis, and the block copolymer has a molecular weight of from greater than 1,100 to less than 50,000.

9. An emulsion according to claim 1, wherein the coefficient of variation of grain equivalent circular diameter, based on total grains, is less than 40 percent.

10. A process of preparing a photographic emulsion having silver halide grains including tabular grains containing greater than 50 mole percent bromide, based on silver, having {111} major faces, and accounting for greater than 90 percent of total grain projected area, said process comprising:

forming in the presence of a dispersing medium containing gelatin and a polyalkylene oxide block copolymer surfactant a population of silver halide grain nuclei containing twin planes, and growing the silver halide grain nuclei containing twin planes in the dispersing medium to form tabular silver halide grains, wherein (a) gelatin in the dispersing medium comprises a modified gelatin of the formula Gel-C(O)-G where Gel represents a gelatin polypeptide, -C(O)- is a carbonyl group from a free carboxyl moiety of an aspartic acid or a glutamic acid component in the polypeptide, and G is a substituent which is free from groups having a pKa of from 3 to 8, and (b) the silver halide grain nuclei are grown at a pH in the range of from3.0to8.0.

11. A process according to claim 10 wherein the grain nuclei are grown at a pH in the range of from 4.0 to 7.0.

12. A process according to claim 10 wherein the grain nuclei are grown at a pH in the range of from 5.0 to 7.0.

13. A process according to claim 10 wherein the grain nuclei are grown at a pH in the range of from 5.0 to 6.0.

14. A process according to claim 10, where G represents—$NR_1R_2$, wherein $R_1$ and $R_2$ each independently represent hydrogen or substituted or unsubstituted alkyl, aryl, arylalkyl, or hetrocylclic groups, or $R_1$ and $R_2$ together form a ring.

15. A process according to claim 14, wherein $R_1$ represents a hydroxy substituted alkyl, aryl, arylalkyl, or hetrocylclic group.

16. A process according to claim 15, wherein $R_2$ represents hydrogen.

17. A process according to claim 16, wherein $R_1$ represents a hydroxy substituted alkyl group of from 1 to 10 carbons.

18. A process according to claim 17, wherein $R_1$ represents a hydroxyethyl group.

19. A process according to claim 10, wherein the polyalkylene oxide block copolymer is selected from the group consisting of (1) LAO1-HAO1-LAO1 where

LAO1 in each occurrence represents a terminal lipophilic alkylene oxide block unit and HAO1 represents a hydrophilic alkylene oxide block linking unit, the HAO1 unit constitutes from 4 to 96 percent of the block copolymer on a weight basis, and the block copolymer has a molecular weight of from 760 to less than 16,000;

(2) HAO2-LAO2-HAO2 where

HAO2 in each occurrence represents a terminal hydrophilic alkylene oxide block unit and LAO2 represents a lipophilic alkylene oxide block linking unit, the LAO2 unit constitutes from 4 to 96 percent of the block copolymer on a weight basis, and the block copolymer has a molecular weight in the range of from 1,000 to of less than 30,000;

(3) $(H\text{-}HAO3)_z\text{-}LOL\text{-}(HAO3\text{-}H)_{z'}$ where

HAO3 in each occurrence represents a terminal hydrophilic alkylene oxide block unit, LOL represents a lipophilic alkylene oxide block linking unit, z is 2 and z' is 1 or 2, the LOL unit constitutes from 4 to 96 percent of the block copolymer on a weight basis, and the block copolymer has a molecular weight in the range of from greater than 1,100 to of less than 60,000; and (4) $(H\text{-}LAO4)_z\text{-}HOL\text{-}(LAO4\text{-}H)_{z'}$ where LAO4 in each occurrence represents a terminal lipophilic alkylene oxide block unit, HOL represents a hydrophilic alkylene oxide block linking unit, z is 2 and z' is 1 or 2, the HOL unit constitutes from 4 to 96 percent of the block copolymer on a weight basis, and the block copolymer has a molecular weight of from greater than 1,100 to less than 50,000.

20. A process according to claim 10, wherein the coefficient of variation of grain equivalent circular diameter, based on total grains, is less than 40 percent.

* * * * *